US008281956B2

(12) United States Patent
Cadden

(10) Patent No.: US 8,281,956 B2
(45) Date of Patent: Oct. 9, 2012

(54) DISPENSING APPARATUS

(76) Inventor: Stephen Cadden, Glasgow (GB)

( * ) Notice: Subject to any disclaimer, the term of this patent is extended or adjusted under 35 U.S.C. 154(b) by 571 days.

(21) Appl. No.: 12/296,668

(22) PCT Filed: Apr. 11, 2007

(86) PCT No.: PCT/GB2007/001333
§ 371 (c)(1),
(2), (4) Date: Mar. 10, 2009

(87) PCT Pub. No.: WO2007/128996
PCT Pub. Date: Nov. 15, 2007

(65) Prior Publication Data

US 2009/0272761 A1 Nov. 5, 2009

(30) Foreign Application Priority Data

Apr. 11, 2006 (GB) ..... 0607273.0

(51) Int. Cl.
*B65D 35/56* (2006.01)

(52) U.S. Cl. ..... 222/105; 222/327; 222/94; 220/255; 24/30.5 R

(58) Field of Classification Search ..... 222/325–327, 222/105, 91, 80, 83, 88, 546, 92–94, 107, 222/545, 136, 95; 383/80, 71, 70; 215/48; 24/30.5 R; 220/265, 255, 255.1
See application file for complete search history.

(56) References Cited

U.S. PATENT DOCUMENTS

| | | | | |
|---|---|---|---|---|
| 2,317,420 | A * | 4/1943 | Taylor | 220/265 |
| 3,711,011 | A * | 1/1973 | Kugler | 383/203 |
| 3,861,522 | A * | 1/1975 | Llewellyn et al. | 206/219 |
| 4,227,612 | A * | 10/1980 | Dillon | 206/219 |
| 4,269,330 | A * | 5/1981 | Johnson | 222/386 |
| 4,340,154 | A * | 7/1982 | VanManen | 222/94 |
| 5,018,877 | A * | 5/1991 | Kantz | 383/67 |
| 5,226,562 | A * | 7/1993 | Kirk | 222/81 |
| 5,404,621 | A * | 4/1995 | Heinke | 24/30 5 R |
| 5,873,492 | A * | 2/1999 | Sullivan | 222/105 |
| 7,182,220 | B2 * | 2/2007 | Raposo | 222/105 |
| 2002/0162859 | A1 * | 11/2002 | Summons et al. | 222/326 |
| 2005/0085786 | A1 | 4/2005 | Baessler et al. | |
| 2005/0139616 | A1 * | 6/2005 | Ichikawa et al. | 222/325 |

FOREIGN PATENT DOCUMENTS

| | | | |
|---|---|---|---|
| EP | 0 151 922 | A2 | 8/1985 |
| EP | 0754633 | | 1/1997 |
| EP | 1382540 | A1 | 1/2004 |
| FR | 2659298 | | 9/1991 |
| WO | 2004076078 | A1 | 9/2004 |

* cited by examiner

*Primary Examiner* — Kevin P Shaver
*Assistant Examiner* — Robert Nichols, II
(74) *Attorney, Agent, or Firm* — Hulquist, PLLC; Frank J. Bozzo; David Bradin

(57) ABSTRACT

The present invention relates to apparatus for the storing and dispensing of products. A cartridge includes at least one sealing element adapted to engage an outer surface of an end of the cartridge to close the end of the cartridge and thereby contain dispensable contents of the cartridge. A substantially rigid outer casing is adapted to receive the cartridge. A removable member is configured to engage the at least one sealing element. The at least one sealing element is adapted such that the at least one sealing element is removed for removal from the cartridge upon removal of the removable member in a single step to enable the contents of the cartridge to be dispensed from the end of the cartridge.

18 Claims, 9 Drawing Sheets

DISPENSING APPARATUS

CROSS-REFERENCE TO RELATED APPLICATIONS

This application claims priority under the provisions of 35 U.S.C. §371 of International Application No. PCT/GB07/01333 filed Apr. 11, 2007, which in turn claims priority of Great Britain Patent Application No. 0607273.0 filed Apr. 11, 2006. The disclosures of such international application and Great Britain priority application are hereby incorporated herein by reference in their respective entireties, for all purposes.

FIELD OF THE INVENTION

The present invention relates to apparatus for the storing and dispensing of products. In particular, the present invention relates to apparatus for the storing and dispensing of inter-reactive compounds wherein the inter-reactive compounds are mixed on extrusion or expulsion.

BACKGROUND OF THE INVENTION

Dispensing apparatus in the form of cartridges is well-known in the art. In many instances, it is necessary to mix at least two different compounds together. On mixing, the compounds may react and usually harden. This type of technology is commonly used in chemical anchors, adhesives, sealants, food processing and medical applications.

Previous dispensing apparatus which requires the mixing of different compounds usually comprises two or more separate moulded compartments i.e. cartridges. These moulded compartments each house respective compounds which are mixed on extrusion or expulsion through an orifice. Additionally, previous types of dispensing apparatus have various limitations such as significant 'tooling-up' costs in machinery for making the separate moulded cartridges. The moulded cartridges are also usually supplied in pre-determined sizes meaning that different dispensing apparatus and pressure guns are required for each different size of cartridge. Moreover, in these types of apparatus, usually at least two pistons are required to obtain the correct mix of different compounds, again further adding to the complexity and cost of such a device.

EP 0754633, which is incorporated herein by reference, relates to cartridge systems used in dispensing devices suitable for dispensing inter-reactive multi-component compositions. The system disclosed in EP 0754633 comprises a clip which is manually pulled out of a container so that a flexible cartridge containing two separate types of material extends beyond the nozzle of the dispensing device. The protruding end of the cartridge is then cut with a knife or a pair of scissors. On extruding said material, the different components are intended to be mixed. However, a number of problems exist with such a system. First of all, the clip is very difficult to pull out meaning that pair of pliers is almost essential to pull the clip out. Furthermore, the use of a knife or scissors is dangerous to a user as a significant amount of pressure is required to cut the cartridge open. Moreover, on cutting the cartridge open, some of the material spills out which necessitates cleaning of the scissors/knife and/or cartridge end.

It is an object of at least one aspect of the present invention to obviate or mitigate at least one or more of the aforementioned problems.

It is a further object of at least aspect of the present invention to provide dispensing apparatus which is easy to use.

It is a yet further object of at least one aspect of the present invention to provide a container for products which can then be used to dispense the product in a simple and effective manner.

A further object of at least one aspect of the present invention is to provide a container for a multi-part chemical product which allows the component parts to be kept separate for storage purposes, but then allows the component parts to be brought together when required for use.

It is a yet further object of at least one aspect of the present invention to provide apparatus for storing products which can also be used for accurate dispensing of the products when required.

SUMMARY OF THE INVENTION

According to a first aspect of the present invention there is provided apparatus for storing and dispensing a product, the apparatus comprising:

a cartridge;

said cartridge comprising at least one sealing means used to contain contents of the cartridge;

a substantially rigid outer casing wherein the substantially rigid outer casing is adapted to receive the cartridge;

a removable member attached to the sealing means;

wherein the at least one sealing means is removed on removal of the removable member.

The cartridge may be 'sausage-like' in shape and may be formed in any suitable extrusion apparatus such as an adapted edible sausage making apparatus.

The cartridge may be made from thin, flexible film with a high tear strength. The cartridge may be made from any suitable plastics material such as polyethylene. Alternatively, the cartridge may be made from a metal/alloy foil.

The material forming the cartridge may also be chosen so that it does not react and/or deteriorate on contact with the contained compounds.

Typically, the cartridge may comprise a plurality of separate chambers, and, in particular, at least two chambers. The chambers may be in the form of elongate segments or concentric sections. The different chambers may contain different compounds which are intended to be mixed. The chambers may be of different volumes and may therefore contain different amounts of the different compounds.

On initial formation of the cartridge, there may be two open ends. Once the compound or compounds are injected into the chamber or separate chambers of the cartridge, the ends of the cartridge may be sealed with any suitable sealing means. The sealing means may comprise a sealing clip. Alternatively, any other suitable sealing means such as crimping, gluing, heat sealing or any form of tie may also be used.

Preferably, on release of the sealing means different contents of the cartridge may mix substantially simultaneously together. This occurs as the single sealing means, seals all of the contents of the cartridge. The mixing may occur immediately meaning that an efficient mix may be obtained.

An end of the cartridge from which the products are intended to be dispensed may be sealed with a sealing clip. The sealing clip may, for example, be wire wound around film forming the cartridge. The sealing clip may be pulled off using any suitable means thereby allowing the contents to be dispensed. An advantage of pulling the clip off is that this may eliminate one of the chambers of the cartridge opening before another, thereby providing an efficient mix. Moreover, as the system does not rely on internal hydrostatic pressure in the cartridge to force the clip off, the cartridge may only be partially filled; such as about 80% or about 50% filled. This may facilitate the manufacturing of the cartridges.

In embodiments where the sealing means are pulled off, there may also be provided means to prevent the sealing means coming off prematurely.

An end of the substantially rigid outer casing may also be crimped to prevent a piston falling out and/or facilitate holding the cartridge in place.

The ease by which the sealing clip may be removed may be determined by the material of the clip, the tightness of the clip and the amount of free film extending beyond the clip. For example, trimming closely to the clip minimises the force to remove the clip.

To facilitate removal of the sealing means, a removable member may be provided. At least part of the removable member may be attached to and/or be located between the cartridge and the sealing means. On removal of the removable member, the sealing means may be removed thereby allowing the contents of the cartridge to be dispensed. In particular embodiments, the sealing means may be removed through a nozzle. The removable member may be of any suitable form and may, for example, be a cap or nut-like member which may be screwed on to an end of the outer casing. On screwing off the cap or nut-like member, the sealing means may be pulled off. The cap or nut-like member may also comprise collapsible grips which may engage in a recess in a cap.

Alternatively, the cap or nut-like member may be removed and thereafter the sealing means removed with any appropriate means such as pliers. The cartridge may also be pushed from behind to engage in a previously fitted cap or nut-like member. A pair of lugs could also be provided which may engage the front end of the nozzle exit and may prevent the clip and skin being forced back in the cartridge body when the cap or nut-like member is subsequently applied and grip engaged.

In certain embodiments, the cartridge may comprise any suitable means which are capable of allowing the contents of the cartridge to be dispensed. For example, the cartridge may comprise a cap which may extend partially around sealing means on the cartridge. By pulling the cap, the sealing means on the cartridge may be broken and/or rupture thereby allowing the contents of the cartridge to be dispensed. The cap may be of any suitable form and may comprise means to facilitate the pulling of the clip. The cap may be initially formed in a two-part form and may attach itself around the sealing means on the cartridge via, for example, a snap fit mechanism or any form of mechanical attachment.

In alternative embodiments, a weakened area on the cartridge may be provided by a series of perforations. On application of pressure to the cartridge, the perforations may form a rupture on the cartridge, thereby allowing the contents of the cartridge to be dispensed.

In further embodiments, the contents of the cartridge may be initially sealed using a heat-sealing process. During the heat-sealing process, the strength and/or integrity of film forming the cartridge may be partially weakened. On application of pressure to the cartridge, this partially weakened area may rupture, thereby allowing the contents of the cartridge to be dispensed.

In further embodiments, the cartridge may initially be formed with a bulbous section at one end, wherein the bulbous section is intended to protrude through the neck portion of the substantially rigid outer casing. The end of the bulbous region may be cut or sheared off, thereby allowing the contents of the cartridge to be dispensed.

In further embodiments, a cap which may be attached to the end of the casing via, for example, screwing, may comprise means to pierce the end of the cartridge. For example, by rotating the cap onto the cartridge, cutting blades which extend from a bottom surface of the cap or clip may cut a substantially circular section into an end of the cartridge thereby allowing the contents of the cartridge to be dispensed.

In yet further embodiments, an end of the cap or clip may comprise chemical means which are intended to react with the film forming the cartridge. On fitting of the cap or clip, a chemical reaction may form a weakened portion on the end of the cartridge, thereby allowing the cartridge to rupture at these weakened areas on application of pressure to an end of the cartridge.

In further embodiments, the cartridge may comprise a clip for each type of component contained separately in the cartridge. On application of pressure to an end of the cartridge, each of the clips at the end of the cartridge are intended to be simultaneously forced off thereby releasing the contents of the cartridge.

The substantially rigid outer casing may be a hollow cylindrical member made from any suitable plastics, metal or alloy material. The outer casing may have an inner cylindrical section which may be of constant diameter from one end to the other. Alternatively, the cylindrical member at one end may have a reduced diameter.

Typically, the outer casing is adapted to receive the cartridge and form a snug fit with the outer walls of the cartridge. The distance between the outer casing and the cartridge may be about 1-10 mm or preferably about 5 mm.

Pressure may be applied to one of the cartridge by any suitable means such as any form of dispensing gun. The pressure may be applied manually or via a pneumatic piston. Typically, the dispensing gun may be a standard mastic gun as found in many DIY stores. Alternatively, any type of syringe like plunger or screw like plunger may be used.

The outer casing may comprise integral reaction shoulders which abut and prevent the cartridge from moving further along the longitudinal length of the outer casing as pressure is applied. The reaction shoulders may be adapted to the shape of the cartridge and may be substantially concave. The actual surface contact area between the reaction shoulder and the cartridge may be specifically chosen. If there is too much surface contact between the reaction shoulder and the cartridge, too much pressure will need to be applied to remove the sealing means from the cartridge and the material forming the cartridge may rupture at any specific point meaning that different compounds in the different chambers may not mix. Alternatively, if there is too little surface contact between the reaction shoulders and the cartridge, the cartridge will be pushed through the outer casing without the sealing means rupturing.

In an alternative embodiment, the reaction shoulder may be formed from a separate insert which may be inserted into the outer casing. In a yet further alternative, the cartridge may be glued to the side of the outer casing thereby preventing movement along the length of the outer casing.

The expansion chamber may be integrally formed in the outer casing during initial moulding. Alternatively, the expansion chamber may be formed by a separate adaptor unit which may be placed into the outer casing. In a further alternative, the expansion chamber may be contained within a separate nozzle member.

Conveniently, the apparatus comprises a nozzle member which may be fitted to an end of the outer casing via, for example, a screw thread. The nozzle may comprise an integral mixer unit which further aids the mixing of the different products in the flexible cartridge. Alternatively, the mixer unit may be a separate item and may be inserted into the nozzle. Preferably, the diameter of the nozzle is wide enough to prevent blockage on release of the sealing means.

The sealing means may be formed from any metal or plastics material such as soft aluminium or steel wire which is wound round the ends of the cartridge. It is also preferred that any sharp ends formed by the sealing means may be pointed away from the flexible cartridge thereby preventing any possible piercing of the cartridge.

An advantage of the apparatus is that once the contents of the cartridge are emptied, the emptied cartridge may be removed and replaced with a new cartridge. The apparatus may therefore be reusable. The emptied cartridge may be removed by simply detaching the pressure gun from the cartridge. To facilitate the removal of the emptied cartridge, the outer casing may have a hinged opening to allow a user easy entry.

The apparatus according to the present invention may be used to provide dispensed products in use for chemical anchors, sealants, food processing and medical applications. Uses of chemical anchors includes securing bolts in concrete/masonry, forming a stud socket and post-installed rebar connections.

Compounds which are intended to be mixed may include any suitable resins, epoxies, polyesters and vinyl esters.

According to a second aspect of the present invention, there is provided a method for dispensing a product, the method comprising:

inserting a cartridge into a substantially rigid outer casing which is adapted to receive the cartridge, said cartridge comprising sealing means used to contain contents of the cartridge;

removing a removable member which removes the sealing means;

wherein the contents of the cartridge are then dispensed.

According to a third aspect of the present invention, there is provided a kit comprising:

a cartridge;

said cartridge comprising at least one sealing means used to contain contents of the cartridge;

a substantially rigid outer casing wherein the substantially rigid outer casing is adapted to receive the cartridge; and wherein the at least one sealing means is removed on removal of the removable member.

Preferably, the dispensing gun is a standard mastic gun.

Typically, the kit may be used to substantially simultaneously mix different compounds.

BRIEF DESCRIPTION OF THE DRAWINGS

Embodiments of the present invention will now be described, by way of example only, with reference to the accompanying drawings in which.

DETAILED DESCRIPTION

Figure 1:
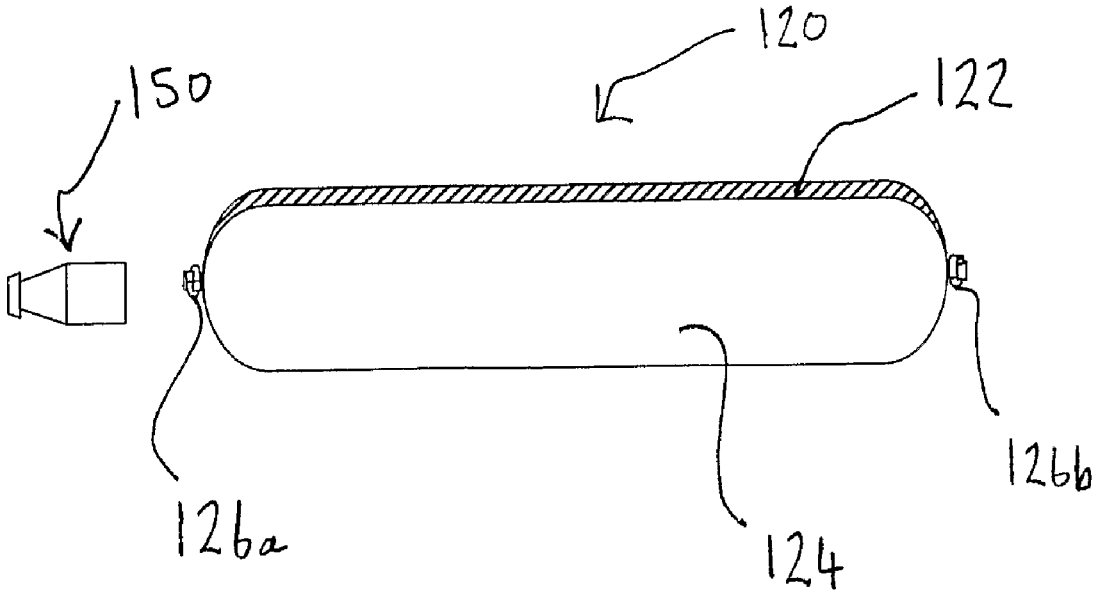
FIG. 1 is a schematic representation of a cartridge and cap according to a first embodiment of the present invention.

Referring to FIG. 1, there is a representation of a cartridge, generally designated 120. The cartridge comprises two separate chambers 122,124. The cartridge 120 is 'sausage-like' in shape. The two separate chambers 122,124 are secured to one another via adhesive means in the 'sausage-like' configuration. Chamber 122 contains compound A and chamber 124 contains compound B. The chambers 122,124 are sealed separate units. The chambers 122,124 are formed from a thin material which has a limited degree of flexibility. The material is chosen so as to be inert towards the materials which they contain. The material may be made from any suitable plastics, polymer or metal foil material.

As shown in FIG. 1, the ends of the cartridge 120 are sealed with sealing clips 126*a*,126*b* once compounds A and B have been inserted into their respective chambers 122,124. Any suitable type of apparatus is used to form the 'sausage-like' cartridge 120. For example, edible sausage making apparatus may be used.

Sealing clips 126*a*,126*b* are formed from relatively soft wire and are wound around the ends of the chambers 122,124 to prevent any leakage of compounds A and B during storage. Careful attachment of the sealing clips 126*a*,126*b* are required so that any sharp ends formed by the sealing clips 126*a*,126*b* do not pierce the cartridge at any time during use of the dispensing apparatus.

Figure 2:
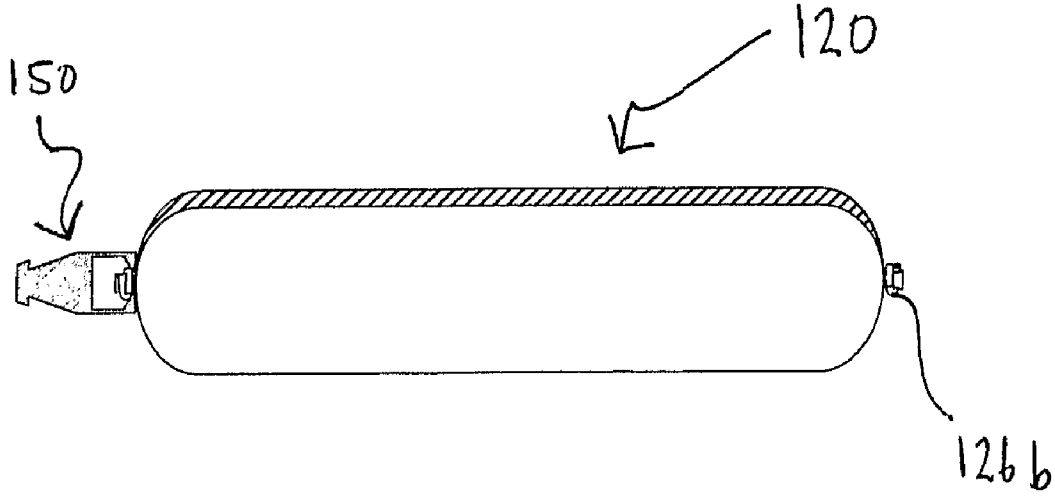
FIG. 2 is a representation of the cap attached to the cartridge shown in FIG. 1.

As shown in FIG. 2, a cap 150 may extend partially around and under the sealing clip 126*a*.

Figure 3:
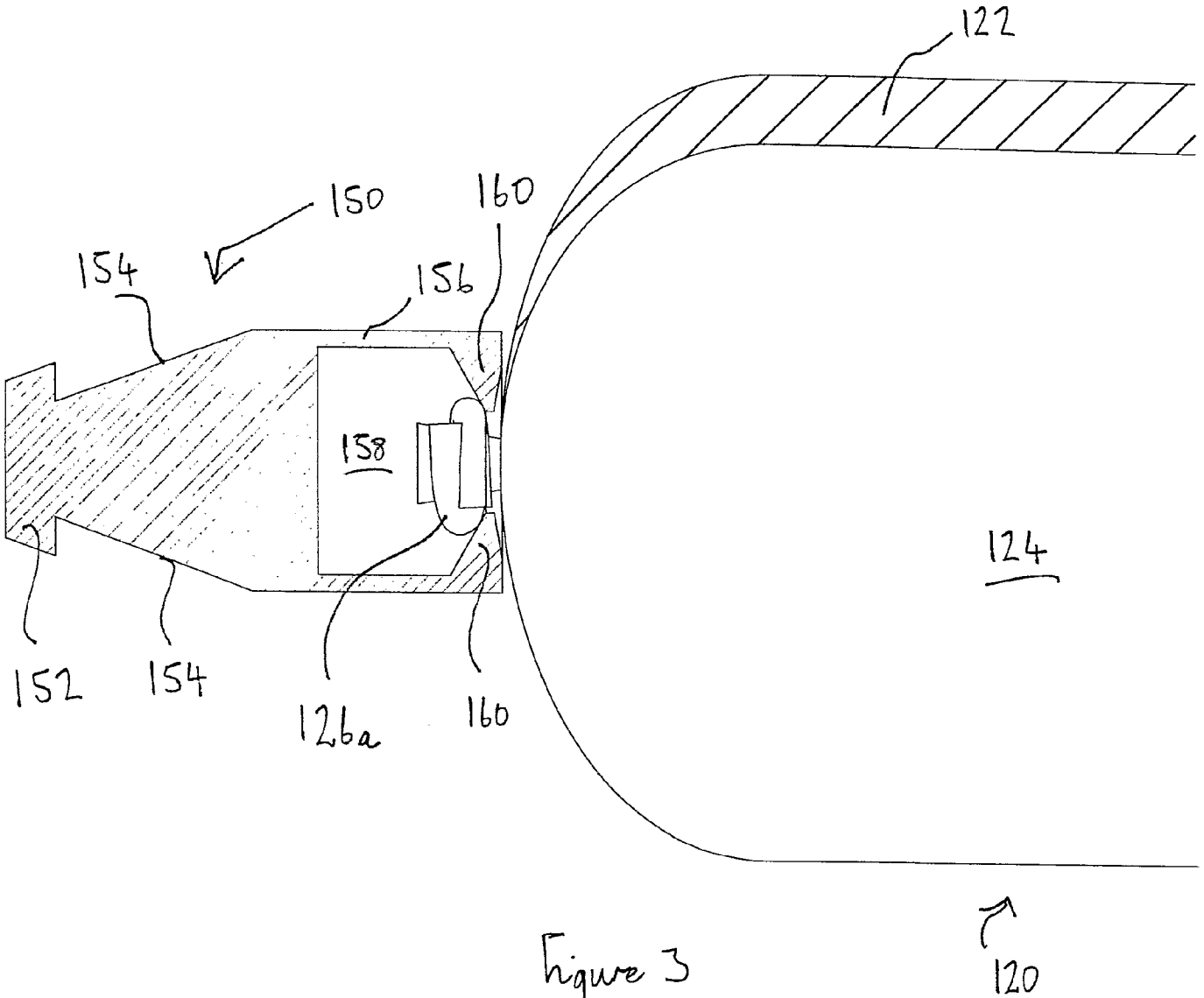
FIG. 3 is an enlarged sectional view of the cap attached to the cartridge as shown in FIG. 2.

FIG. 3 is an expanded view of the cap 150 extending around the sealing clip 126*a*. As shown in FIG. 3, the cap 150 comprises a substantially annular protruding section 160 which inserts itself between the sealing clip 126*a* and the top end of the cartridge 120. The cap 150 contains a substantially tubular section containing an inner void 158. Thereafter, the cap has a tapered section 154 and a protruding tab section 152.

The cap 150 may be pulled manually or with a pair of pliers using the tab section 152 to improve grip. On removal of the cap 150, the sealing clip 126*a* is pulled off the end of the cartridge 120. On removal of the sealing clip 126*a* from the cartridge 120, the contents of the cartridge may be dispensed.

Figure 4:
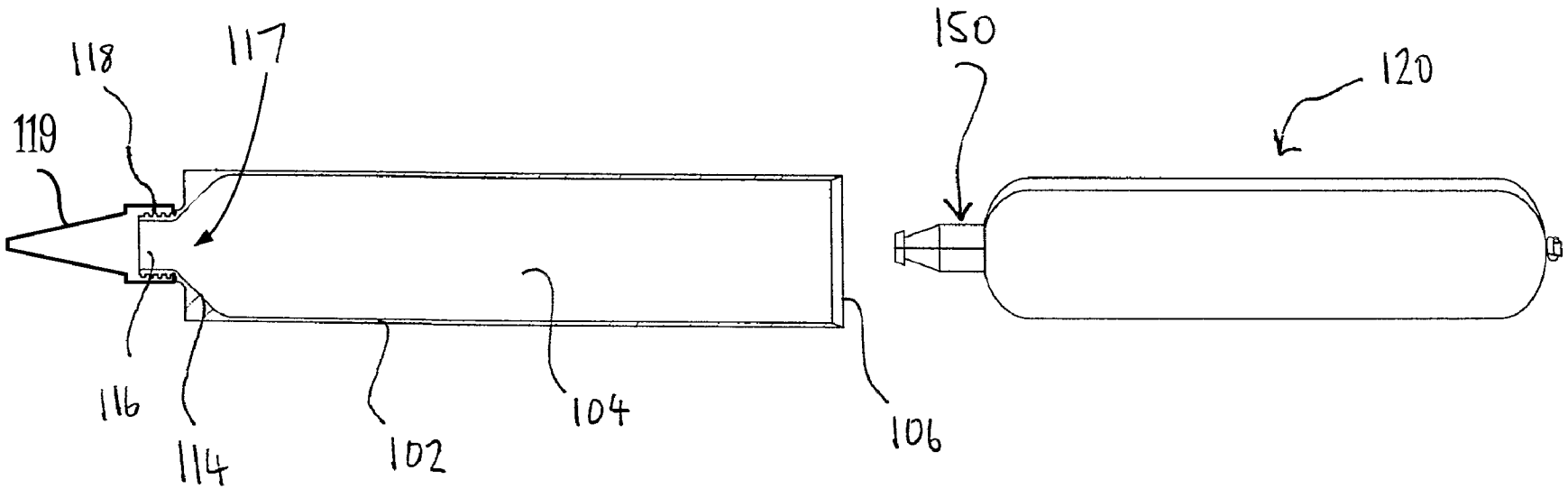
FIG. 4 is a representation of a cartridge with an attached cap ready to be received into a casing.

FIG. 4 is a representation of a cartridge 120 which has a cap 150 attached and which is ready to be inserted into a casing 102. The casing 102 comprises an inner surface 104 and an end 106 through which the cartridge 120 is inserted. The other end of the casing 102 comprises an expansion chamber 117 into which the cartridge 120 may partially extend upon application of pressure to an end of the cartridge 120, and an area of reduced diameter 114 through which the cartridge 120 extends. At the end of the casing 102 there is a tubular section 116 with a thread 118 extending there around. A nozzle 119 may be fitted to an end of the casing 102.

Figure 5:
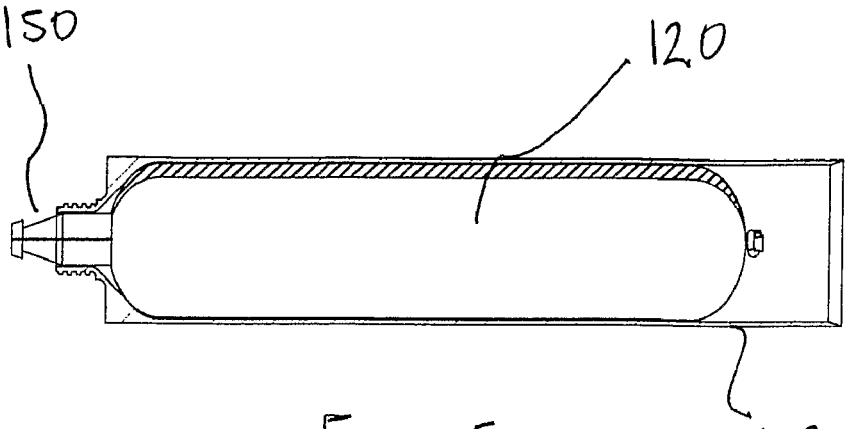
FIGS. 5-7 are representations of the cap being released from the cartridge.
Figure 6:
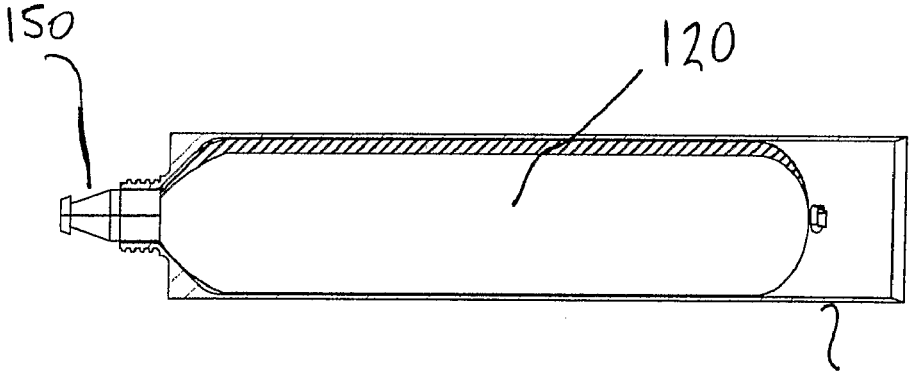
Figure 7:
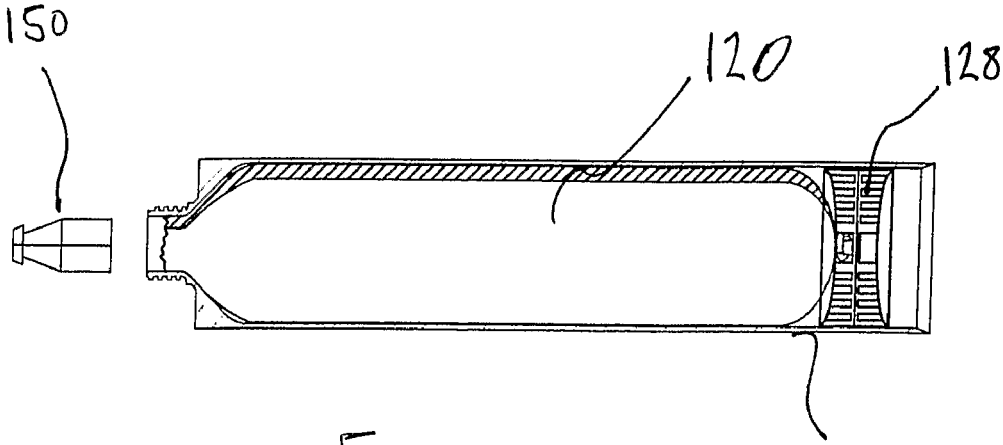
Figure 8:
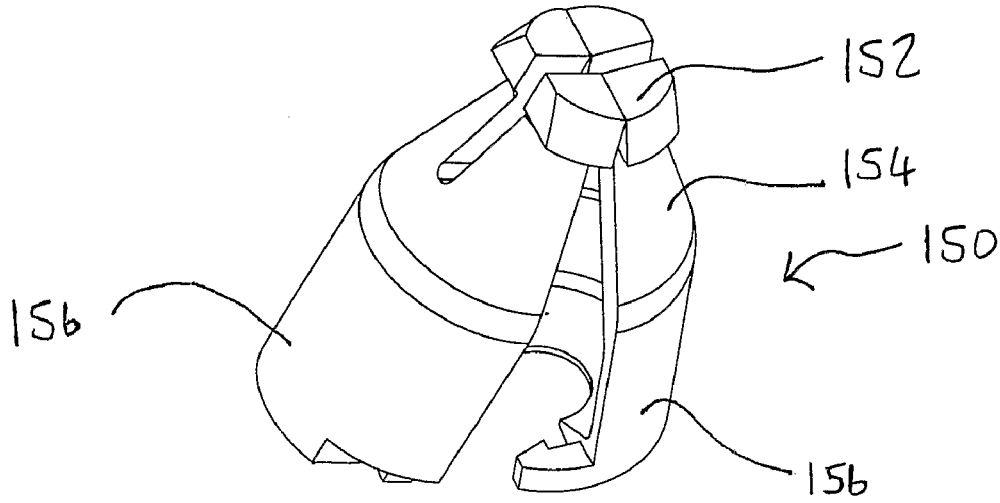
FIGS. 8-12 are representations of a cap according to a further embodiment of the present invention.
Figure 9:
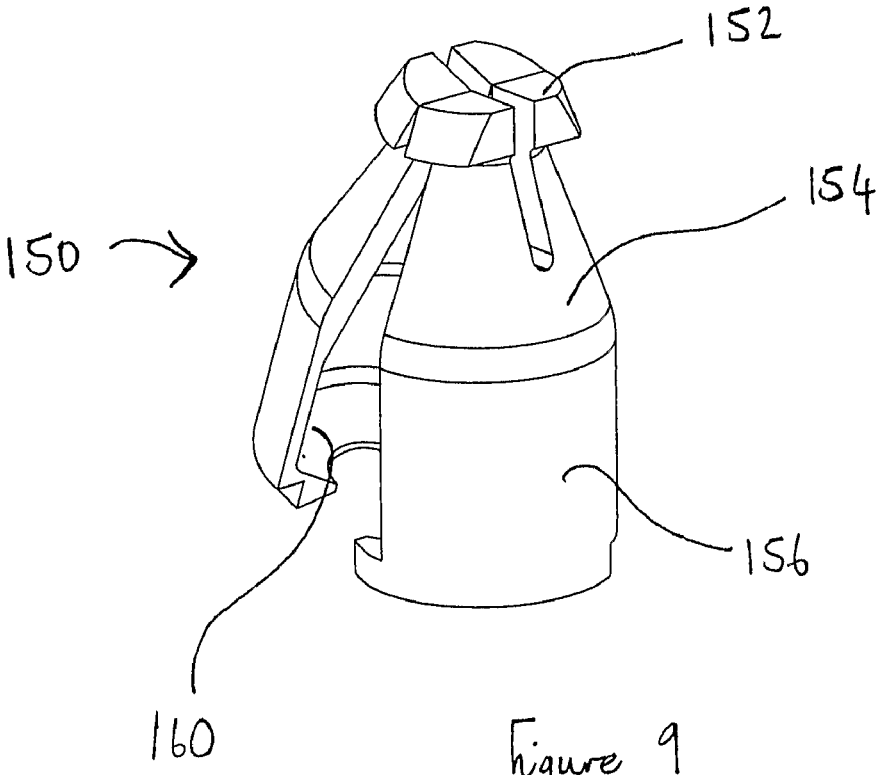
Figure 10:
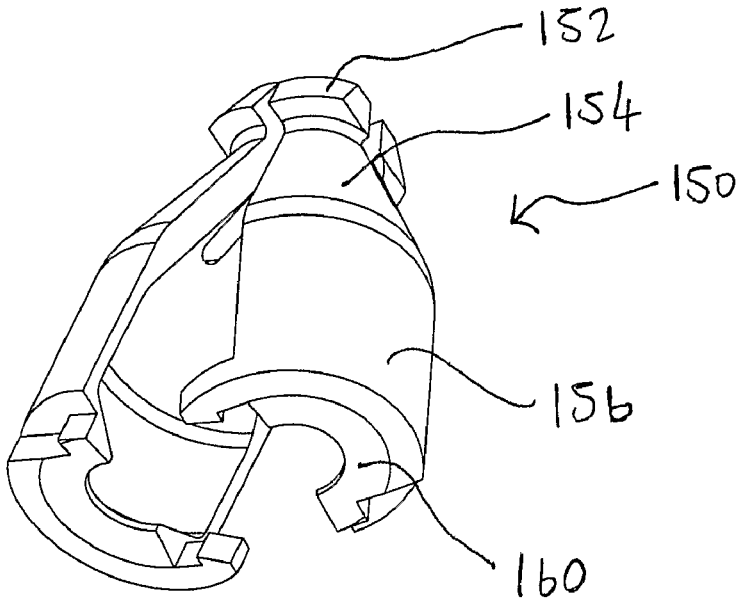
Figure 11:
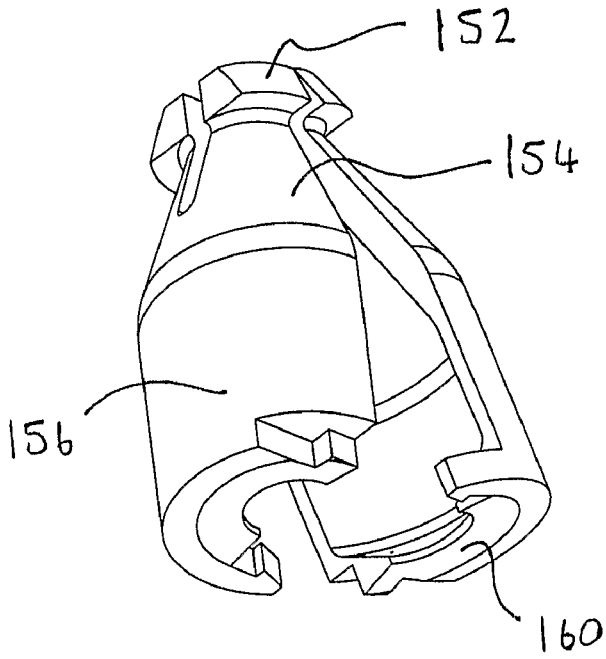
Figure 12:
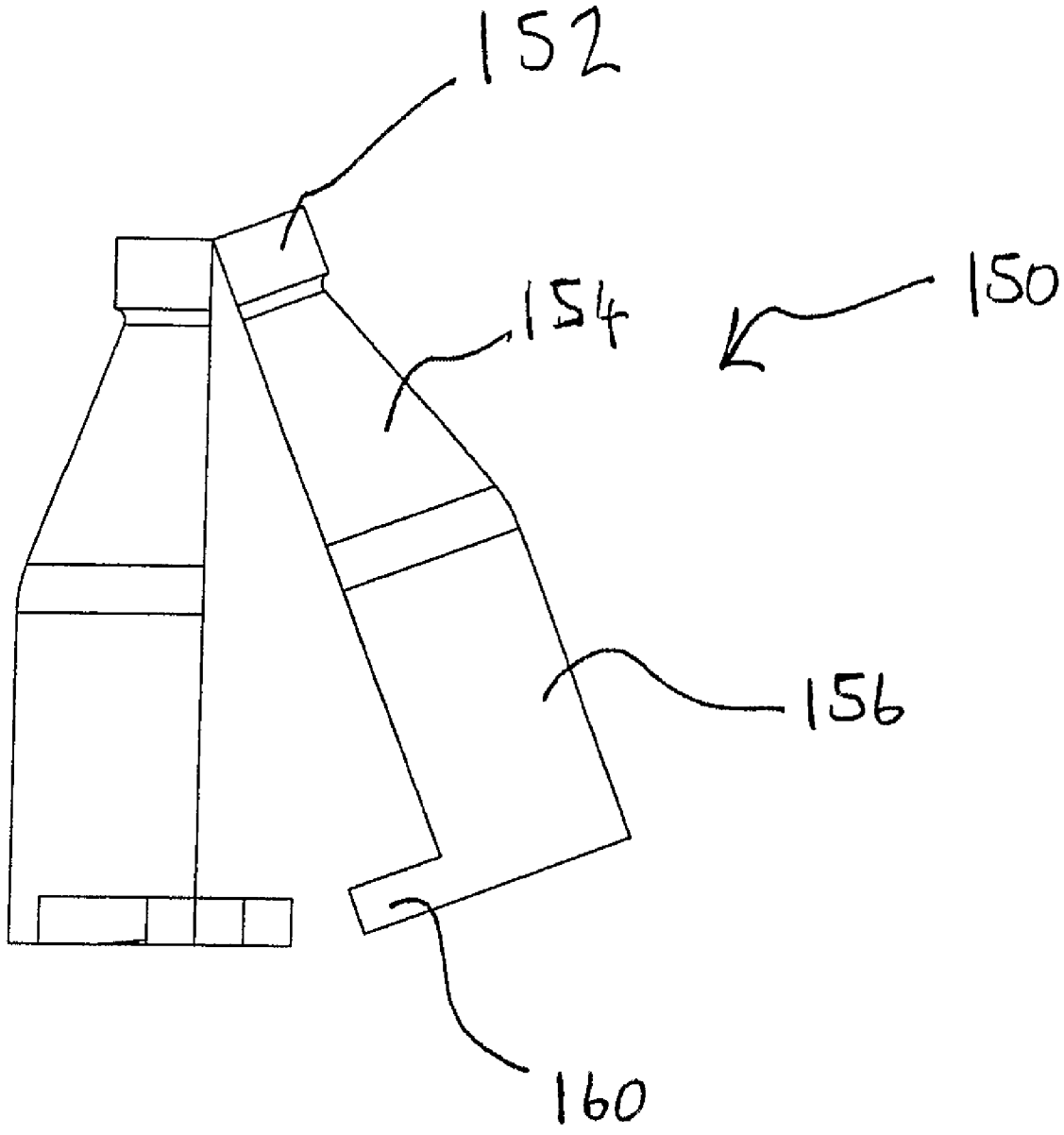

FIG. 5 shows the cap 150 attached to the threads 118 at the end of the casing 102. When the cartridge 120 is ready to be used, a pulling force may be exerted on the cap 150 which initially distorts the cartridge 120 into a bulbous form as shown in FIG. 6. On application of further pressure, the cap 150 is fully removed taking with it the sealing clip 126*a* thereby allowing the contents of the cartridge 120 to be dispensed. FIG. 7 shows that a back plate 128 may be used to dispense the contents of the cartridge 120. Any form of suitable dispensing gun may be used.

FIGS. 8-12 are representations of the cap 150. At the end of the cap 150, there is the tab section 152 which facilitates fingers or pliers applying pulling force to the cap 150 to remove the cap 150 from the cartridge 120. The cap 150 comprises a substantially conical section 154 and a substantially tubular section 156. At the end of the cap 150, there is an end section 160 which is adapted to fit around and under the sealing means 126*a*. On application of a pulling force to the cap 150, the end protruding section 160 therefore pulls the sealing clip 126*a* off the cartridge 120.

Figure 13:
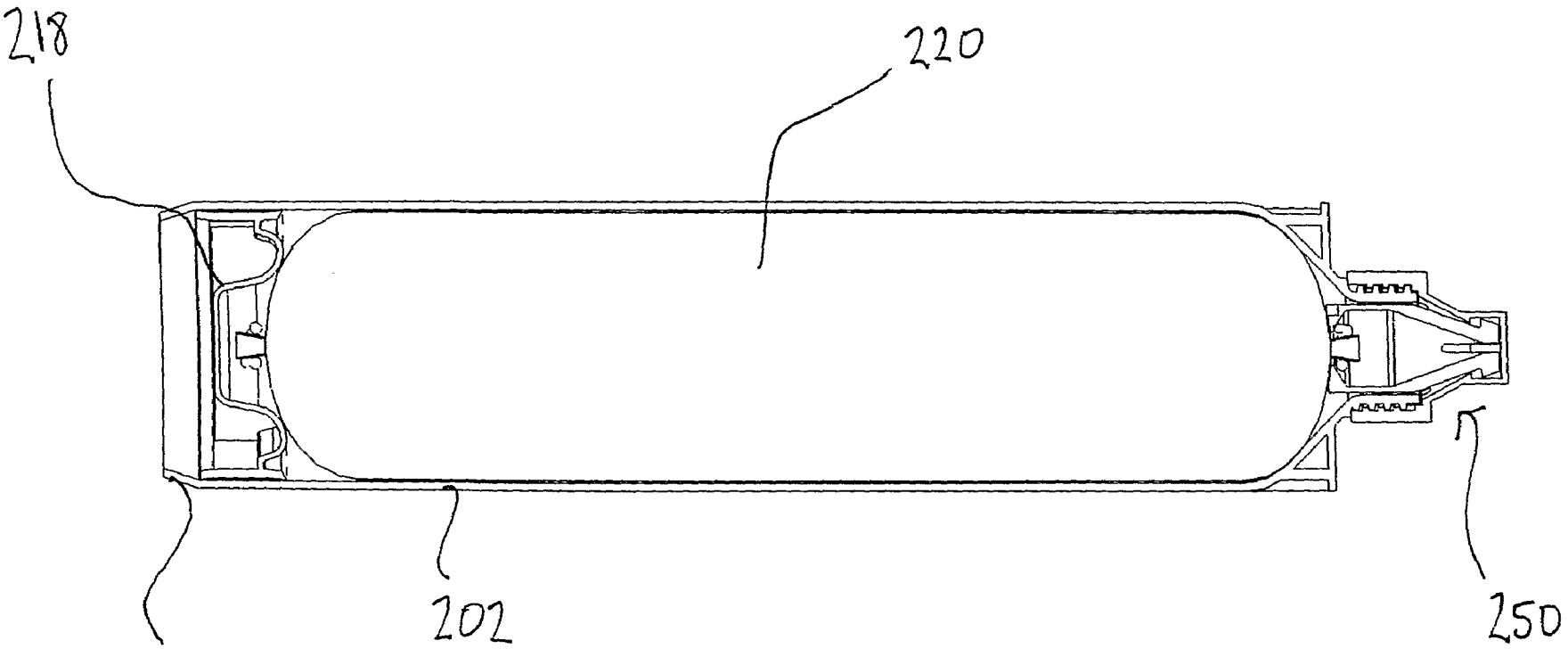
FIG. 13 is a representation of a cartridge and cap according to a yet further embodiment of the present invention.

FIG. 13 shows a further embodiment of the present invention wherein a cartridge 220 is enclosed within a casing 202. As shown in FIG. 13, the casing 202 has a crimped section 202*a* which prevents piston means 218 accidentally falling out of the casing 202. This helps to prevent any spillage.

Figure 14:
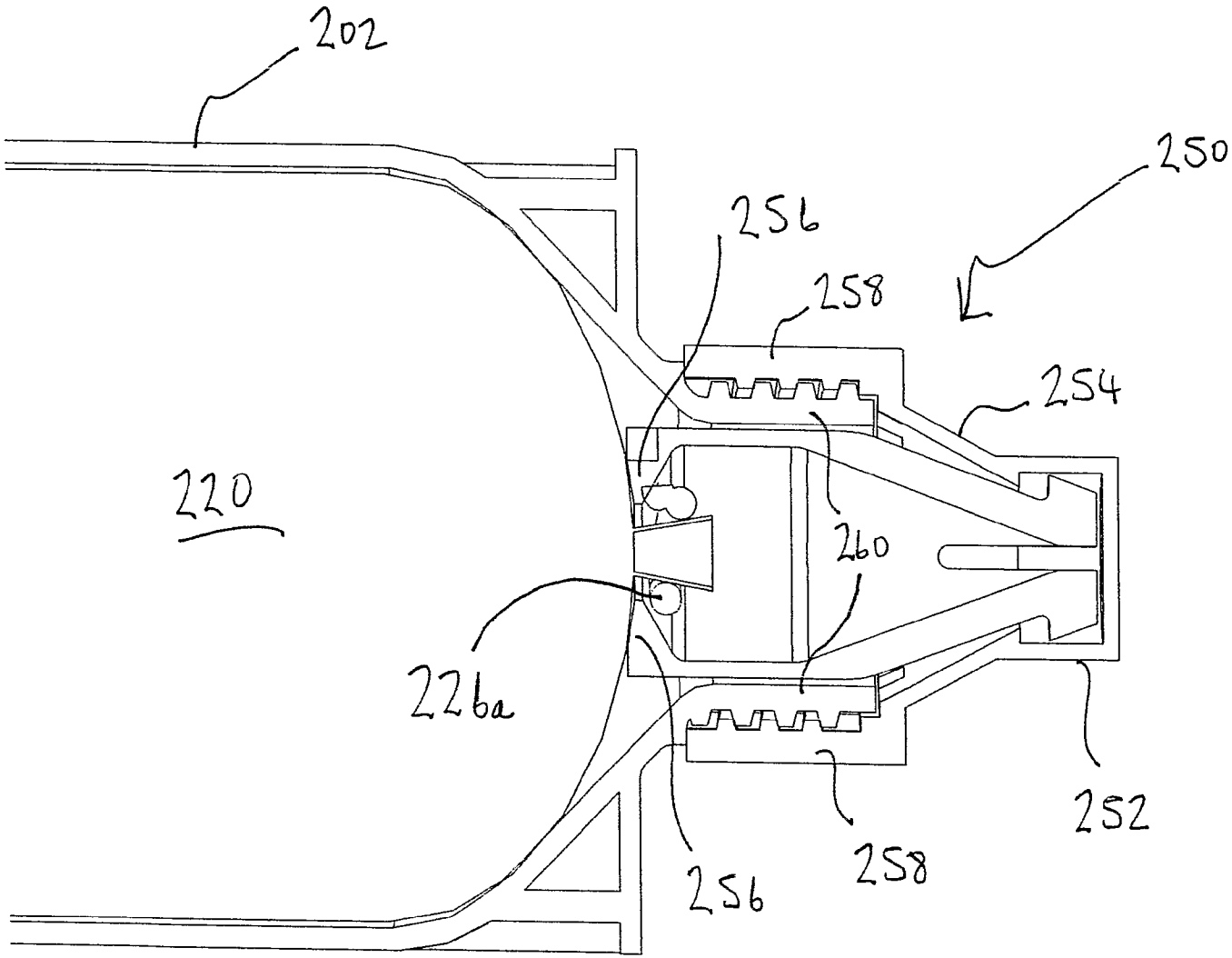
FIG. 14 is an enlarged sectional view of the cap attached to the cartridge as shown in FIG. 13.

FIG. 14 is an expanded view of the front end of the cartridge 220 shown in FIG. 13. As shown in FIG. 14, the cap 250 comprises a tab 252, a conical section 254 and thereafter a tubular section 258. The tubular section 258 has an internal thread which is adapted to be received on a thread on the casing 202. Furthermore, as shown in FIG. 14, the cap 250 comprises protruding portions 256 which extend underneath the sealing clip 226*a*.

In use, the cap 250 may be screwed off the end of the casing 202. As the cap 250 is screwed off, the protruding members 256 are pulled away from the cartridge 220 which has the effect of removing the sealing clip 226*a*. Therefore, on removal of the cap 250, the sealing clip 226*a* is removed from the cartridge 220, thereby allowing the contents of the cartridge 220 to be dispensed. The cap 250 may be of any suitable arrangement and may either contain an integral inner moulding which may be used to remove the sealing clip 226*a* or may have a separate member for such a purpose.

Whilst specific embodiments of the invention have been described above, it will be appreciated that departures from the described embodiments may still fall within the scope of the invention. For example, any means of allowing the different contents of the cartridge to be dispensed simultaneously may be used. For example, this may include any form of means of pulling retention clips from the cartridge or piercing the end of the cartridge. Moreover, the end of the cartridge may comprise weakened areas or areas of perforations or areas weakened by heat-sealing, which may rupture on application of pressure.

The invention claimed is:

1. An apparatus for storing and dispensing a product, the apparatus comprising:

a cartridge comprising;

at least one sealing clip adapted to be wound around an outside of the cartridge to close the end of the cartridge and thereby contain dispensable contents of the cartridge;

a substantially rigid outer casing adapted to receive the cartridge; and a removable member configured to engage the at least one sealing clip from at least one of around and beneath the at least one sealing clip;

wherein the at least one sealing clip is adapted such that the at least one sealing clip is pulled off of the end of the cartridge upon removal of the removable member in a single step to enable the contents of the cartridge to be dispensed from the end of the cartridge, and wherein the removable member is configured not to be removable from the cartridge without removing the sealing clip.

2. The apparatus of claim 1, wherein at least a portion of the removable member is attached between and/or located between at least a portion of the cartridge and at least a portion of the at least one sealing clip.

3. The apparatus of claim 1, wherein the removable member is further attached to the substantially rigid outer casing.

4. The apparatus of claim 1, wherein the removable member comprises a cap or nut-like member adapted for threaded attachment to an end of the substantially rigid outer casing.

5. The apparatus of claim 1, wherein at least a portion of the cartridge is fabricated of a thin, flexible film with high tear strength.

6. The apparatus of claim 1, wherein the cartridge defines a plurality of separate chambers containing a plurality of different compounds, wherein each separate chamber contains a different compound of a plurality of compounds, and wherein the cartridge is adapted to promote mixing of the plurality of compounds upon removal of the at least one sealing clip.

7. The apparatus of claim 1, adapted to promote substantially simultaneous mixing of different contents of the cartridge upon removal of the at least one sealing clip.

8. The apparatus of claim 1, wherein the substantially rigid outer casing is crimped at one end thereby preventing removal of a piston and/or facilitating the holding of the cartridge in place.

9. The apparatus of claim 1, further comprising a dispensing gun arranged to apply pressure to an end of the cartridge.

10. The apparatus of claim 1, wherein the substantially rigid outer casing comprises an expansion chamber into which the cartridge may partially extend upon application of pressure to an end of the cartridge.

11. The apparatus of claim 1, further comprising a nozzle member adapted to aid in dispensing the contents from the cartridge.

12. The apparatus of claim 1, wherein the contents comprise any of resins, epoxies, polyesters, and vinyl esters.

13. The apparatus of claim 1, wherein the at least one sealing clip is comprised of wire wound around the outer surface of the end of the cartridge.

14. The apparatus of claim 1, wherein the at least one sealing clip is removable to enable the cartridge to be opened without cutting the cartridge.

15. A method for dispensing a product, the method comprising:

inserting a cartridge into a substantially rigid outer casing that is adapted to receive the cartridge, said cartridge comprising a sealing clip adapted to be wound around an outer surface of the cartridge near an end of the cartridge to close the end of the cartridge and thereby contain contents of the cartridge, and wherein the sealing clip is engaged by a removable member from at least one of around and beneath the sealing clip wherein the removable member is configured not to be removable from the cartridge without removing the sealing clip from the cartridge and thereby enabling dispensing of the contents of the cartridge; and removing the removable member that effects removal of the sealing clip in a single step, thereby permitting dispensation of the contents of the cartridge.

16. A method according to claim 15, wherein the removable member comprises a cap or nut-like member screwed onto an end of the outer casing, and wherein upon removal of the cap or nut-like member, the sealing clip is removed.

17. The method of claim 15, further comprising sealing the cartridge by wrapping wire around the outer surface near the end of the cartridge to form the at least one sealing clip.

18. A kit comprising:

a cartridge;

at least one sealing clip adapted to be wound around an outer surface of the cartridge near an end of the cartridge to close the end of the cartridge to prevent dispensing of contents of the cartridge from the end of the cartridge when the at least one sealing clip is in place near the end of the cartridge;

a substantially rigid outer casing, wherein the substantially rigid outer casing is adapted to receive the cartridge; and a removable member configured to engage the at least one sealing clip from at least one of around and beneath the sealing clip such that, once the removable member is engaged with the at least one sealing clip, moving the removable member away from the end of the cartridge removes the at least one sealing clip from the cartridge to permit dispensing of the contents of the cartridge, wherein the removable member is configured not to be removable from the cartridge without removing the sealing clip; and a dispensing gun.

* * * * *